US005738320A

United States Patent [19]

Matos et al.

[11] Patent Number: 5,738,320

[45] Date of Patent: Apr. 14, 1998

[54] SUPPORT SHELF FOR COMPUTER MONITORS

[75] Inventors: Brian E. Matos, Canton; James T. Weisburn, Massillon; Christopher G. Gallagher, Akron, all of Ohio

[73] Assignee: Fellowes Manufacturing Company, Itasca, Ill.

[21] Appl. No.: 645,285

[22] Filed: May 13, 1996

[51] Int. Cl.[6] ..... A47B 57/04

[52] U.S. Cl. ..... 248/242; 248/292.12; 248/220.21; 248/918; 108/1

[58] Field of Search ..... 248/242, 274.1, 248/291.1, 292.12, 918, 220.21; 108/1, 157

[56] References Cited

U.S. PATENT DOCUMENTS

| | | | |
|---|---|---|---|
| 4,632,471 | 12/1986 | Visnapuu | 312/233 |
| 4,730,760 | 3/1988 | Keller | 224/550 X |
| 4,902,078 | 2/1990 | Judd | 312/7.2 |
| 4,960,257 | 10/1990 | Waters | 248/442.2 |
| 5,035,392 | 7/1991 | Gross et al. | 248/442.2 |
| 5,074,512 | 12/1991 | Gianforcaro et al. | 248/442.2 |
| 5,078,358 | 1/1992 | Eqly et al. | 248/447.1 |
| 5,104,088 | 4/1992 | Bakanowsky | 248/442.2 |
| 5,122,941 | 6/1992 | Gross | 362/276 |
| 5,125,612 | 6/1992 | McNeal | 248/442.2 |
| 5,190,258 | 3/1993 | Yu | 248/279 |
| 5,292,099 | 3/1994 | Isham et al. | 248/442.2 |
| 5,385,327 | 1/1995 | Hegarty et al. | 348/918 X |
| 5,615,854 | 4/1997 | Normura et al. | 248/287.1 |

*Primary Examiner*—Ramon O. Ramirez
*Assistant Examiner*—Stephen S. Wentsler
*Attorney, Agent, or Firm*—Brinks Hofer Gilson & Lione

[57] ABSTRACT

A support shelf amounts on a computer monitor for supporting multi-media speakers or other office related items above a horizontal work surface. A base positively locks to an upright in one of a plurality of angularly adjusted positions which allow the upright to support the base horizontally on a titled monitor. The upright has a mounting plate which attaches to the top of the monitor and supports a panel which extends vertically along the side of the monitor. An adjustment plate extends perpendicularly from the bottom of the panel above the work surface and has an inverted V-shape with a flange extending from each side thereof. The base has a square-shaped support surface with a top lip to prevent the speaker or other items from sliding off of the shelf. A bracket is formed with a plurality of horizontally aligned spaced channels on the bottom of the base for receiving the adjustment plate to mount the base to the upright. Each flange of the adjustment plate is selectively engageable into a selected pair of the channels to positively fix the base in a desired angular position.

14 Claims, 5 Drawing Sheets

SUPPORT SHELF FOR COMPUTER MONITORS

BACKGROUND OF THE INVENTION

1. Technical Field

The invention relates to a support shelf for computer monitors. More particularly, the invention relates to a shelf that attaches to the monitor of a personal computer and supports speakers, as well as other office related items, above a horizontal work surface. Even more particularly, the invention relates to a support shelf which positively locks in a selected angularly adjusted position to horizontally support the speakers or other items from a tilted monitor.

2. Background Information

Presently, the personal computer is a standard piece of equipment in the office environment. However, most personal computers are ergonomically unsatisfactory for computer operators. One reason is that there is usually not enough horizontal work space available to the operator. Items such as floppy disks, pen and pencil holders, coffee mugs, etc. can usually be found occupying horizontal work space on an operator's office desk. These items are in addition to materials that the operator needs to use or to which the operator may need to refer to do his or her work.

The development of multi-media in the form of CD ROM drives has led to an increase in the use of audio speakers along with personal computers. These speakers sit on each side of the computer monitor and output audio signals produced by the computer. These speakers also occupy horizontal work space in that the multi-media systems require that the speakers be placed adjacent each side of the monitor for the operator to receive the full effect of the multi-media output.

A variety of devices have been proposed to increase the work space associated with personal computers by providing devices to support speakers, papers etc. on the monitor and off the adjacent work surface. Many of these devices support the various items vertically thus increasing the amount of available horizontal work space. For example, U.S. Pat. No. 5,035,392 shows a device which attaches to either or both sides of a monitor and includes lighting fixtures for illuminating the surface of any documents being displayed. A hinge is attached between a vertical post and a holder which secures the device to the monitor.

U.S. Pat. No. 5,190,258 shows a support assembly on which the monitor is supported that includes first and second arms which pivot from a retracted position to an extended position and support detachably mounted speakers.

U.S. Pat. No. 5,292,099 includes a U-shaped adjustable attachment means which clamps the device to the monitor and allows a document holder to be hingedly mounted on each side of the monitor. U.S. Pat. Nos. 5,104,088 and 4,902,078 both include pivoting extending arms which are adhered to the top of a monitor. The extending arms include a document holder clip to retain a document.

U.S. Pat. No. 4,632,471 shows a computer video work station with a copyholder which has a display framing panel positioned in front of and generally parallel to the front of the monitor to permit viewing of the monitor screen through the panel.

U.S. Pat. No. 4,960,257 shows an easel with a support member with a base, a plurality of extension members and an axis of rotation which permits the support member to be rotated relative to the document.

U.S. Pat. No. 5,074,512 shows a monitor-mountable adjustable assembly for supporting a sheet of drawings, using a drawing-mouse or digital tablet cursor. The assembly includes a vice for adjustably mounting the assembly on computer monitors of various sizes.

U.S. Pat. No. 5,078,358 shows a copy holder which includes a beam with a locking mechanism for receiving and locking sheets of paper to the beam, a securing mechanism for securing the beam to an object such as a monitor, and a support member for supporting the back of the paper which is held by the locking mechanism.

U.S. Pat. No. 5,122,941 shows a video terminal accessory with an attachment mechanism, a display board and an adjustable support mechanism. The support mechanism includes three tubular members which are connected and rotatable relative to each other.

U.S. Pat. No. 5,125,612 shows a video screen bracket which includes ring like members which pass through apertures in worksheets and allow the operator to flip the sheet over a laterally extending boom which vertically supports the rings and sheets.

Many of these prior art devices include brackets and support arms which horizontally pivot and suspend items above the work space. These devices are restricted to supporting those items which they were specifically intended to support. The support shelf of the present invention provides a base which may include a recessed area for supporting speakers or other office related items, and provides a greater surface area for supporting a wider variety of items.

Another problem with many of these prior art devices is that often the user will tilt the computer monitor to improve the angular relationship between the user's eyes and the monitor's screen. The prior art devices which are not angularly adjustable will mount on the tilted monitor and support the items at the same angle as that of the tilted monitor. This may cause the items to slide or fall off these prior art support stands. Likewise, if the prior art stands do not positively lock into the angularly adjusted position, the support member may be accidentally bumped and rotated causing any items held thereon to fall off the support stand.

Although these prior art devices were adequate for the purpose for which they were intended, the shelf of the present invention improves on these devices by providing a shelf which mounts to either side of the monitor and includes an angularly adjustable support surface which compensates for tilted monitors and supports the items above and generally parallel to a horizontal work surface regardless of the angle of the monitor. The present invention further improves upon the prior art devices by providing a support shelf which positively locks in the angularly adjusted position to prevent the support surface from accidentally rotating when bumped by the operator or supporting excess weight.

Therefore, the need exists for an improved support shelf which is easily attachable to a computer monitor to support speakers and other office related items above a work surface, and which has a support surface which can be adjusted and positively locked into one of several angular positions to allow the supported items to be horizontally supported from a titled monitor. There is no such support shelf of which we are aware which accomplishes these results.

SUMMARY OF THE INVENTION

Objectives of the present invention include providing a support shelf which is preferably formed of a lightweight plastic, such as a styrene, which is inexpensive to manufacture and ship, yet sturdy enough to support the weight of a speaker.

Another objective of the present invention is to provide such a support shelf which includes a pair of easily assembled sections which positively lock together in one of several angularly adjusted positions to prevent the shelf from prematurely rotating when bumped by an operator or supporting excess weight.

A further objective of the present invention is to provide such a support shelf which mounts to a titled monitor and supports the speakers or other office related items horizontally above a work surface regardless of the monitor angle.

A still further objective of the present invention is to provide such a support shelf which is easily attachable to a computer monitor and is adapted to extend adjacent to a side thereof.

A further objective of the present invention is to provide such a support shelf which has a relatively large support surface with an upwardly extending lip to prevent items held thereon from sliding off the shelf.

Another objective of the present invention is to provide such a support shelf which comprises two separate component parts that enable the support shelf to be shipped in a flat compact condition and then easily assembled by the user after purchasing the shelf.

These objectives and advantages are obtained by the improved support shelf for computer monitors of the present invention, the general nature of which may be stated as including an upright having a longitudinal axis adapted to extend adjacent to a side of the monitor; a base mounted on and extending outwardly from the upright adapted to extend above a work surface; and attachment means for adjustably mounting the base on the upright, said attachment means includes a plurality of channels formed in one of the upright and base, and flanges formed on the other of said upright and base and selectively engageable in certain of the channels for positively securing said base in a fixed position on the upright with the base extending at an angular relationship with respect to the longitudinal axis of the upright.

BRIEF DESCRIPTION OF THE DRAWINGS

The preferred embodiment of the invention, illustrative of the best mode in which applicants have contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
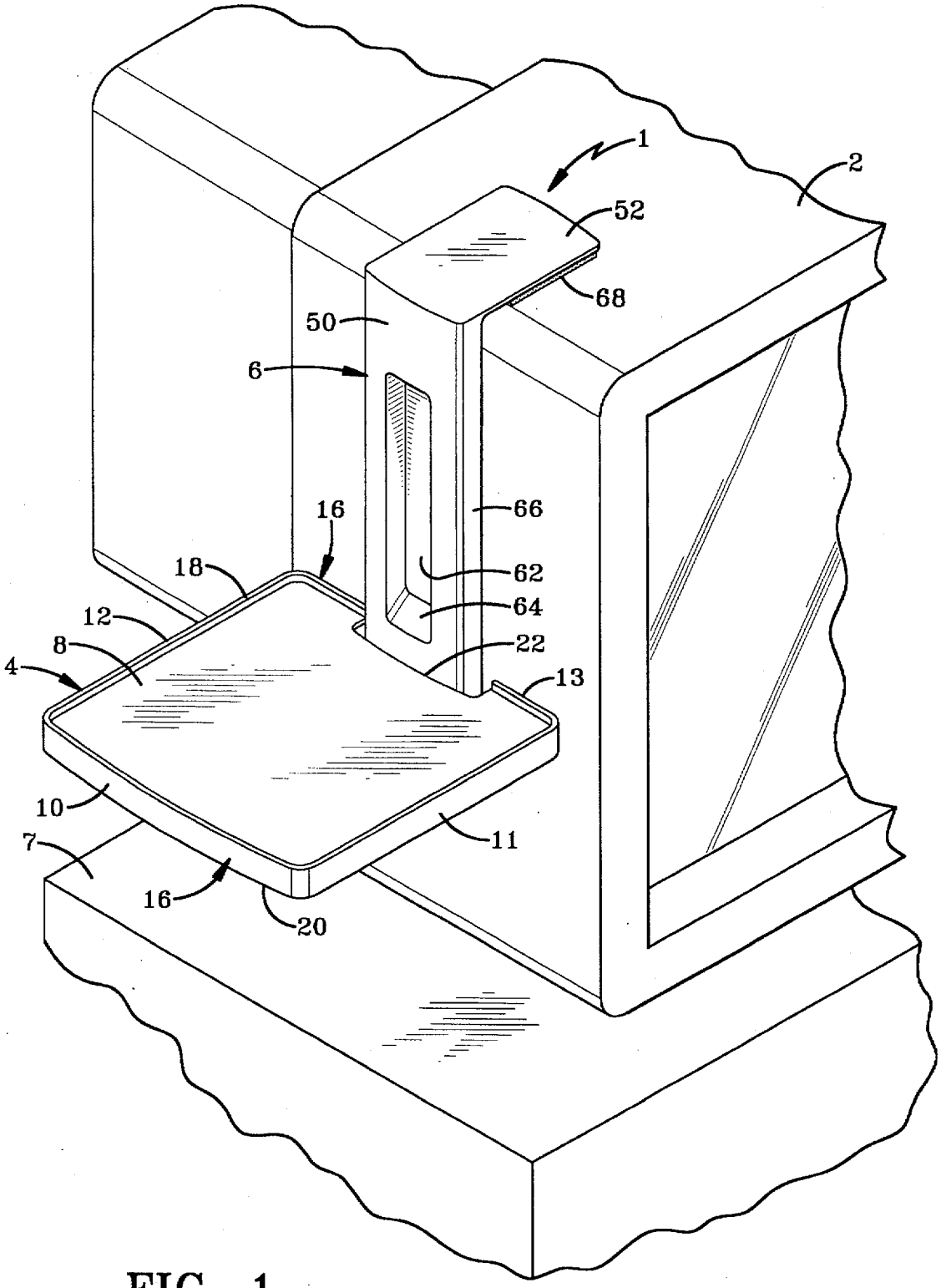
FIG. 1 a perspective view of the support shelf of the present invention shown attached to a monitor shown in fragmentary.

The support shelf of the present invention is indicated generally at 1, and is shown in FIG. 1 attached to a monitor 2. Shelf 1 is preferably molded of a rigid plastic material, such as a styrene, and includes a square base 4 which positively and removably attaches to a vertically extending Z-shaped upright or bracket 6 and is supported thereby above a horizontal work surface 7. Base 4 and upright 6 are both integral one-piece members which can be molded in mass quantities of the selected types of plastic material.

Figure 2:
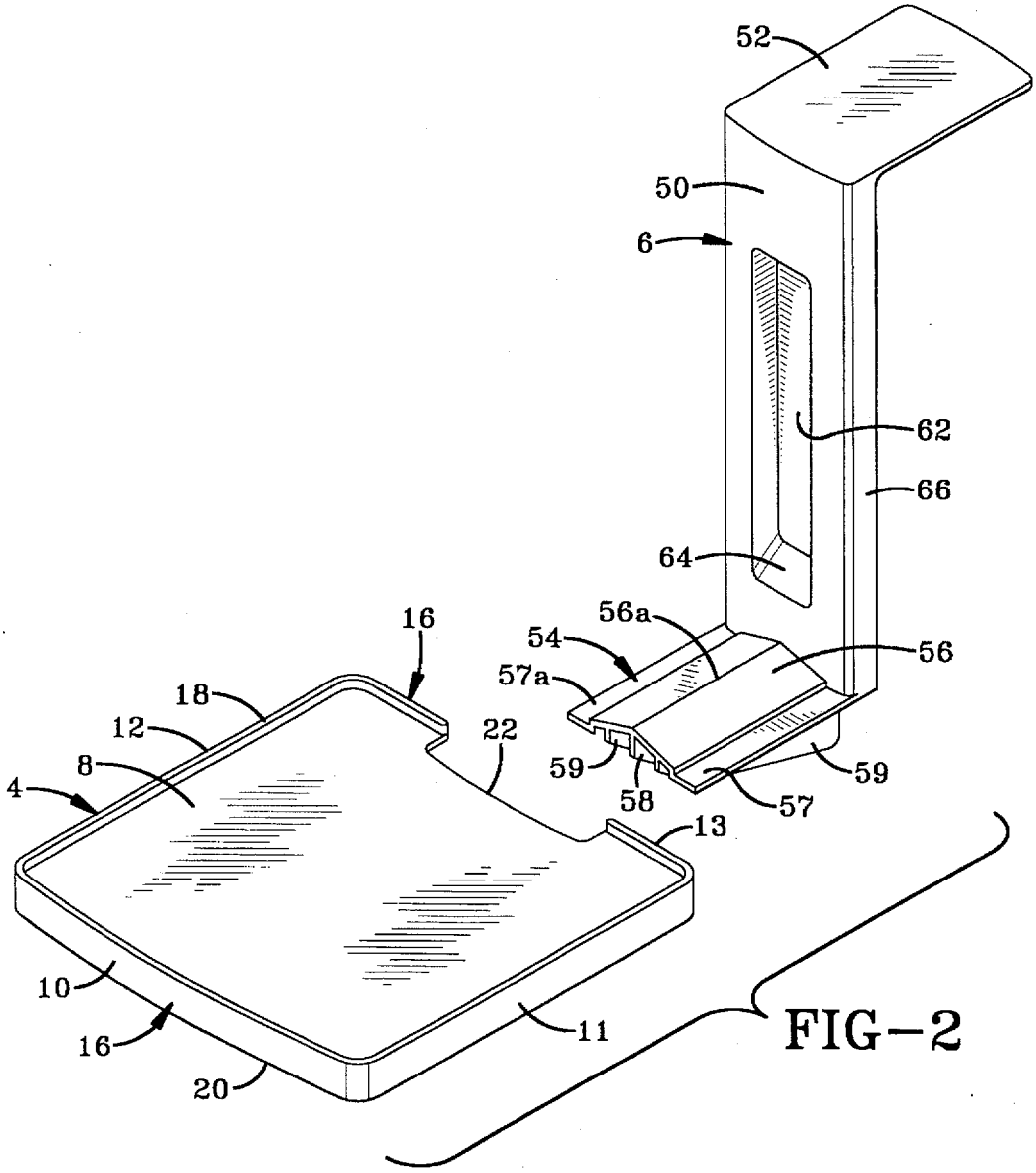
FIG. 2 is an exploded view showing the upright and base of the support shelf of FIG. 1.

Base 4 includes a flat support surface 8 which has a front 10, right and left sides 11 and 12, respectively, and a rear 13. A peripheral wall 16 extends across front 10, sides 11 and 12, and partially across rear 13 from each side 11 and 12. Wall 16 extends above and below support surface 8 and forms top and bottom lips 18 and 20 (FIGS. 3–8), respectively. An elongated U-shaped opening 22 (FIGS. 1 and 2) is formed in support surface 8 and extends transversely across the middle of rear 13 intermediate the ends of wall 16.

Figure 3:
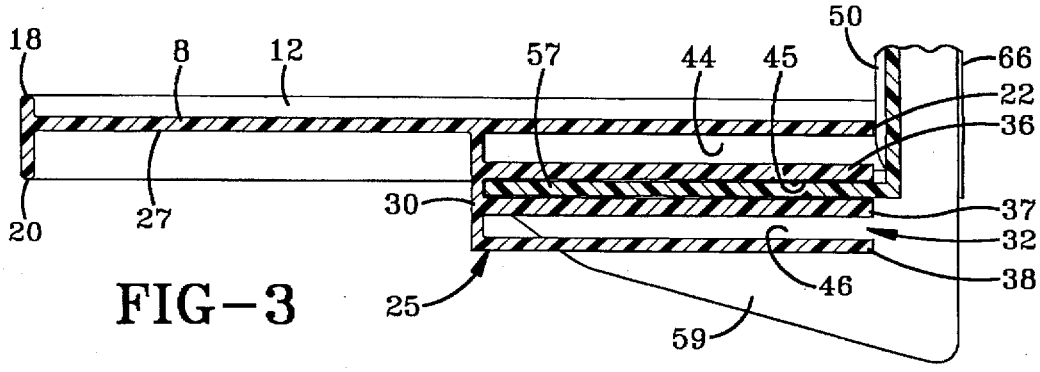
FIG. 3 is a side sectional view showing the support shelf positively locked in a first angularly adjusted position.

A mounting bracket 25 (FIGS. 3–8) is formed integrally with and extends downwardly from a bottom 27 of support surface 8 and is positioned intermediate sides 11 and 12, and adjacent to opening 22. Bracket 25 includes a vertical front wall 30 (FIG. 3) which extends between spaced parallel right and left side walls 28 and 29 (FIGS. 4–8), respectively, and has an open rear end 32 (FIG. 3).

Three spaced parallel adjustment tabs 36, 37 and 38 (FIGS. 3–8) extend inwardly toward each other from each wall 28 and 29. Adjustment tabs 36–38 and bottom 27 of support surface 8 form three pairs of horizontally aligned channels 44, 45 and 46. Channels 44 are formed between bottom 27 of support surface 8 and tabs 36, channels 45 are formed between tabs 36 and 37, and channels 46 are formed between tabs 37 and 38. The inner ends of adjustment tabs 36–38 form a central gap 48 (FIGS. 4–8) therebetween.

Upright 6 has a generally Z-shaped configuration and includes an elongated rectangular-shaped central panel 50 (FIGS. 1 and 2), a rectangular-shaped mounting plate or leg 52 which extends perpendicularly in one direction from the top of panel 50, and an adjustment mounting plate or leg 54 which extends perpendicularly in the other direction from the bottom of panel 50 and parallel with mounting plate 52. Panel 50 is formed with a middle rectangular-shaped opening 62 with tapered edges 64 to reduce the weight and material needed to form upright 6. A pair of side walls 66 extend longitudinally along the sides of panel 50 and sit adjacent the side of monitor 2 when shelf 1 is mounted thereon (FIG. 1). Panel 50 has a longitudinal centerline or axis 51 adapted to extend generally parallel to a side of monitor 2 when support shelf 1 is assembled and mounted thereon.

Adjustment mounting plate 54 (FIGS. 2 and 4–8) has an inverted V-shaped central section 56 which extends angularly downwardly from an apex **56*a* at an angle of approximately 17° with respect to the horizontal. A pair of flanges 57 and 57*a* extend outwardly from the left and right outer ends, respectively, of V-shaped section 56 and are joined thereto by generally right-angled stepped shoulders. A generally triangular-shaped middle fin 58 and a pair of similarly shaped side fins 59 extend vertically downwardly from the bottom surface of apex 56*a* of V-shaped section 56. Fins 58 and 59 are angled rearwardly with respect to adjustment plate 54 (FIGS. 2 and 3) and terminate in alignment with the rear edges of side walls 66 of panel 50**.

In accordance with the invention, base 4 positively locks to upright 6 in one of five angularly adjusted positions. Top mounting plate 52 extends along the top of monitor 2 (FIG. 1) and is removably mounted thereto by a strip of double adhesive tape or VELCRO hook and loop fastener 68. Panel 50 extends downwardly from top mounting plate 52 along the side of monitor 2 and terminates at adjustment plate 54. Plate 54 extends perpendicularly outwardly from panel 50, through open rear end 32 and into central gap 48 of bracket 25 to removably mount base 4 on upright 6. Each flange 57 and 57*a* is selectively engageable in one of channels 44–46 to positively lock base 4 to upright 6 and to support base 4 in a generally horizontal position, parallel to and above work surface 7 regardless of the angle of monitor 2. The rear of fins 58 and 59 abut the side of monitor 2 to assist in supporting base 4 above work surface 7.

Figure 4:
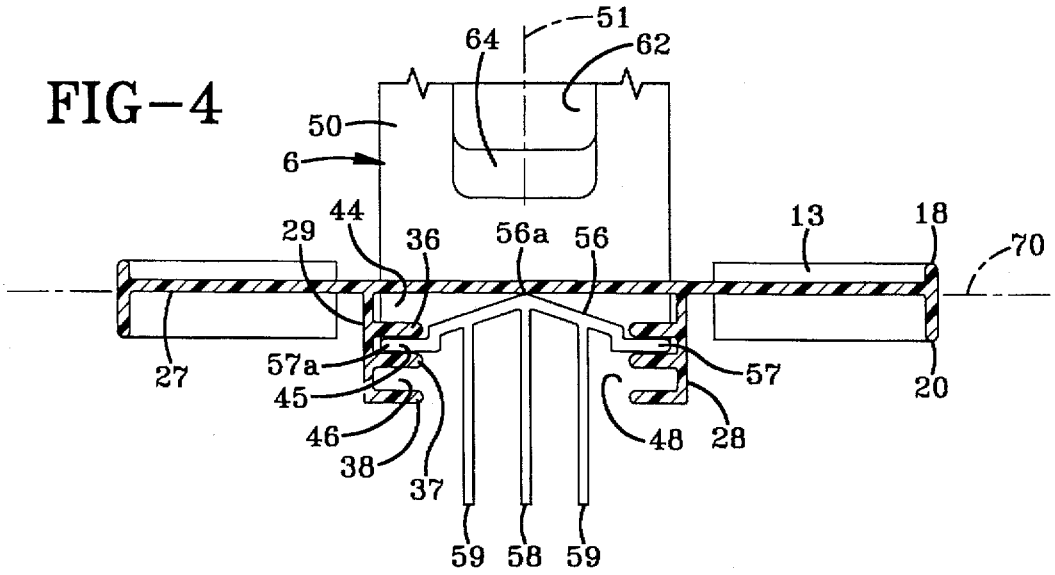
FIG. 4 is a front sectional view showing the shelf in the first adjusted position of FIG. 3.

A first angularly adjusted position is shown in FIG. 4 with base 4 positively locked to upright 6 at a 90° angle to longitudinal axis 51 and in a horizontal plane 70. Right flange 57 extends into gap 45 of right wall 28 and left flange 57*a* extends into gap 45 of left wall 29. Apex 56*a* of V-shaped section 56 of adjustment plate 54 abuts bottom 27 of support surface 8 intermediate right and left walls 28 and 29, respectively, to provide additional support and stability thereto. The inner ends of tabs 36 sit adjacent the stepped shoulders of flanges 57 and 57*a*, and fins 58 and 59 extend out the bottom of bracket 25 for engagement with the side of monitor 2. Panel 50 extends into opening 22 to allow wall 16 of base 4 to abut the side of monitor 2 (FIG. 1).

Figure 5:
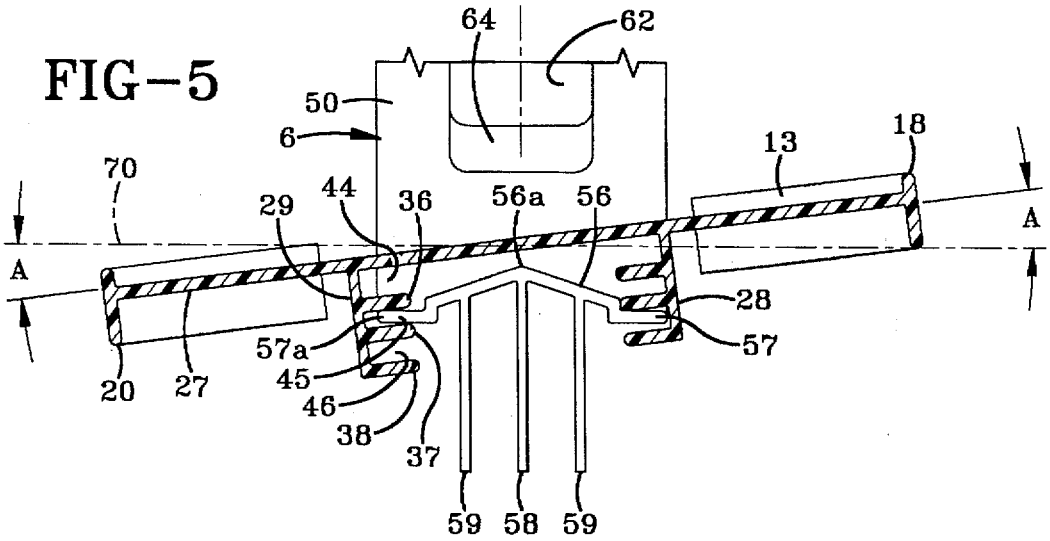
FIG. 5 is a front sectional view similar to FIG. 4 showing a second angularly adjusted position.

Base 4 is shown in FIG. 5 positively locked to upright 6 in a second angularly adjusted position. Right flange 57 extends into channel 46 of right wall 28 and left flange 57*a* extends into channel 45 of left wall 29. Base 4 sits angularly downwardly from right to left at an angle A which is approximately 7° with respect to horizontal plane 70. The angular orientation of base 4 in FIG. 5 causes tab 37 of wall 28 to abut the stepped shoulder of flange 57. Opening 22 is slightly larger than the transverse width of panel 50 to allow panel 50 to sit at an angle therein.

Figure 6:
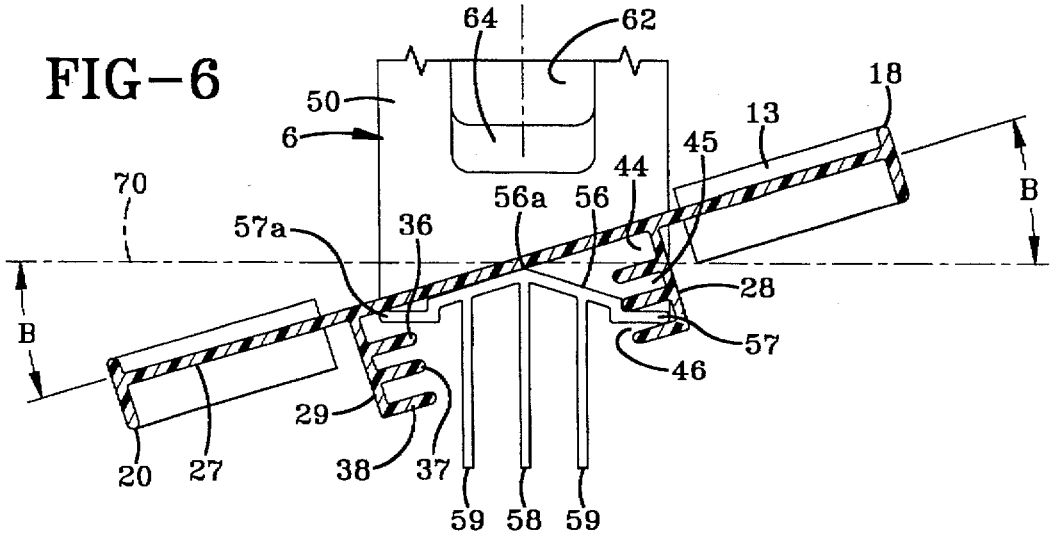
FIG. 6 is a front sectional view similar to FIGS. 4 and 5 showing a third angularly adjusted position.

In a third angularly adjusted position, shown in FIG. 6, base 4 is positively locked to upright 6 and extends angularly downwardly from right to left at an angle B which is approximately 17° with respect to horizontal plane 70. Right flange 57 extends into channel 46 of right wall 28 and left flange 57*a* extends into channel 44 of left wall 29. The top left surface of V-shaped section 56 of plate 54 sits flush against bottom 27 of support surface 8 to assist in supporting base 4 above work surface 7. Adjustment tab 37 of wall 28 abuts the stepped shoulder of flanges 57 and the outer end of flange 57*a* abuts bottom surface 27 of support surface 8.

Figure 7:
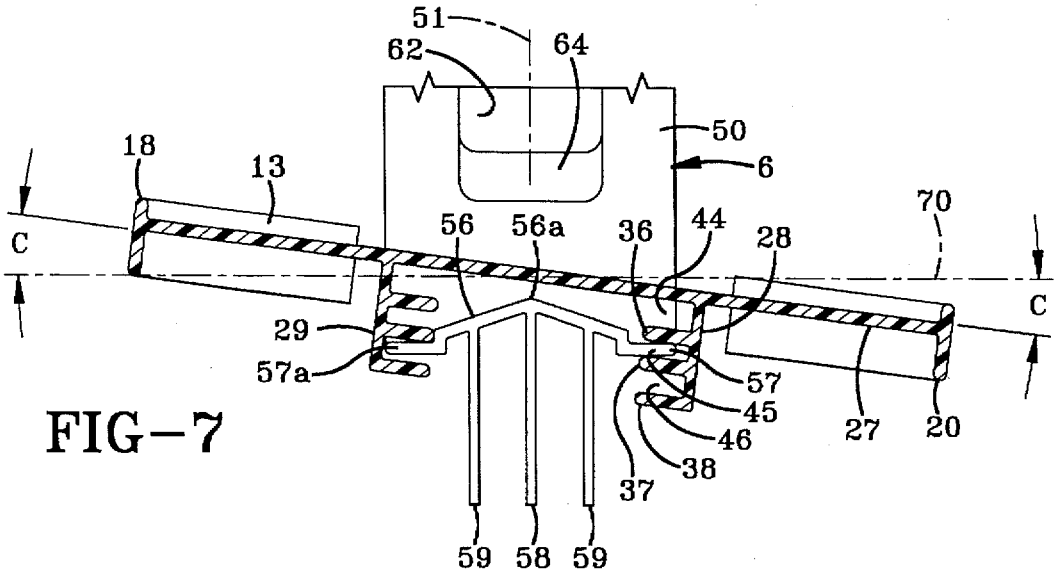
FIG. 7 is a front sectional view similar to FIGS. 4—6 showing a fourth angularly adjusted position.

A fourth angularly adjusted position is shown in FIG. 7 with base 4 positively locked to upright 6 at an angle C which is approximately 7° with respect to horizontal plane 70. Base 4 extends angularly downwardly from left to right in at equal but opposite angle as that of FIG. 5. Right flange 57 extends into channel 45 of right wall 28 and left flange 57*a* extends into channel 46 of left wall 29. The angular orientation of FIG. 7 causes tab 37 of wall 29 to abut the stepped shoulder of flange 57*a*.

Figure 8:
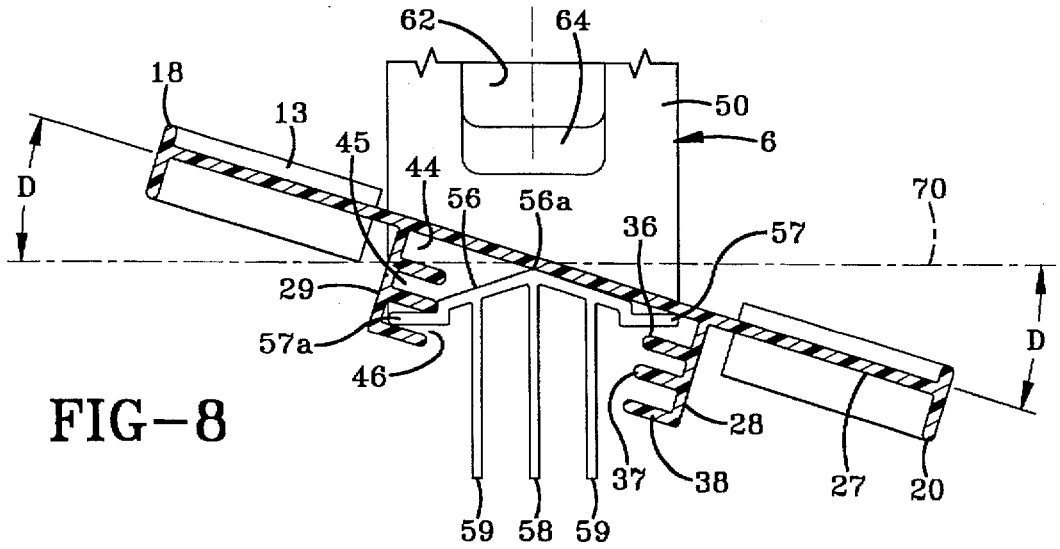
FIG. 8 is a front sectional view similar to FIGS. 4–7 showing a fifth angularly adjusted position.
Figure 9:
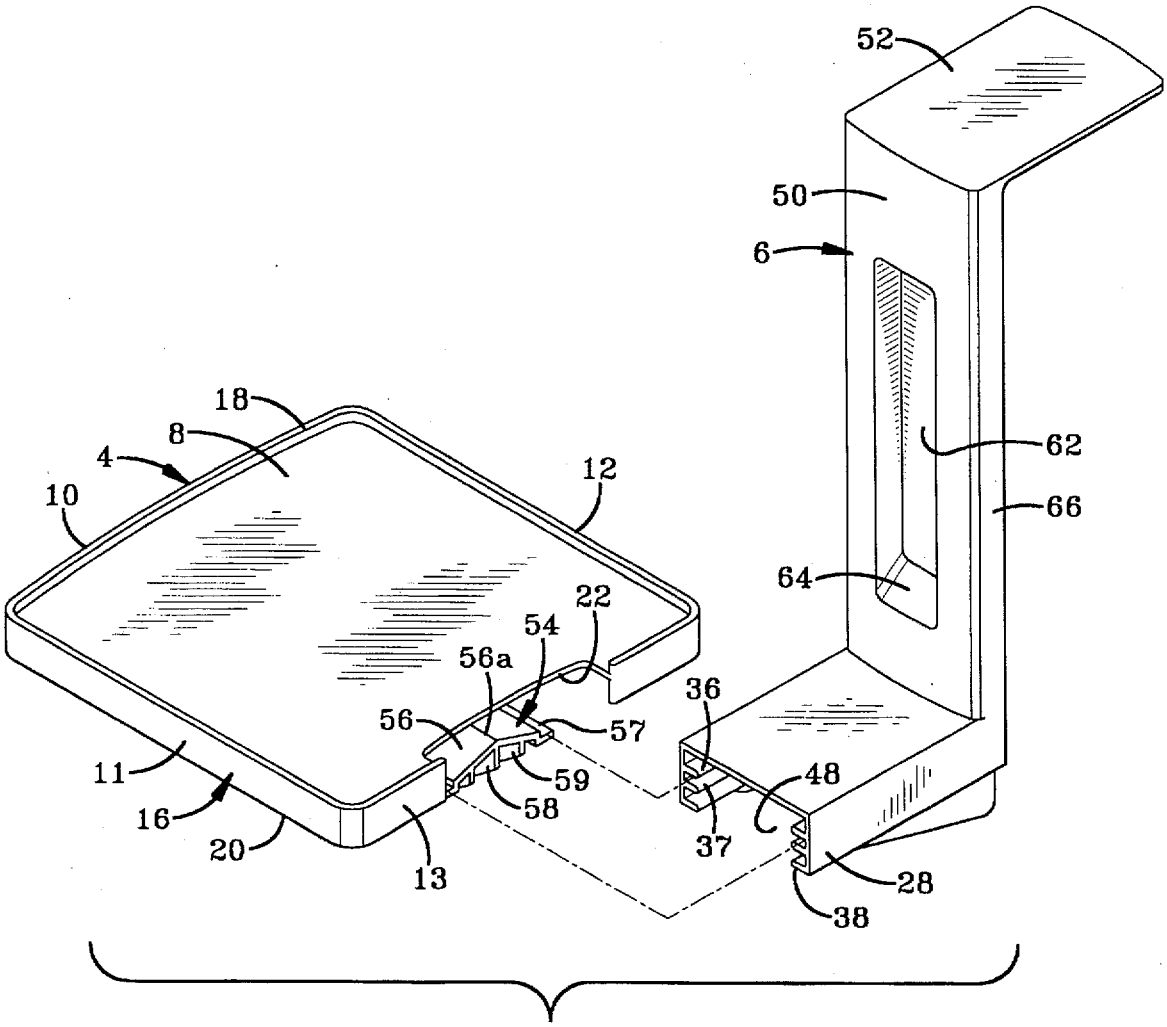
FIG. 9 is an exploded perspective view similar to FIG. 2 of a modified upright and base of the support shelf.
Figure 10:
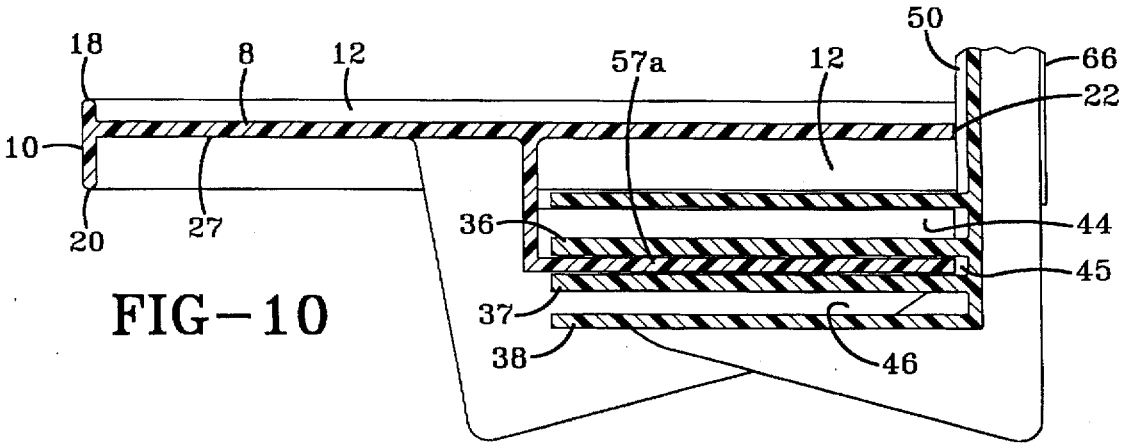
FIG. 10 is a fragmentary sectional view similar to FIG. 3 showing the modified support shelf and base of FIG. 9 in an engaged position.

A fifth angularly adjusted position is shown in FIG. 8 with base 4 positively locked to upright 6. Base 4 extends angularly downwardly at an equal but opposite angle as the third position of FIG. 6. Base 4 extends angularly downwardly from left to right at an angle D which is approximately 17° with respect to horizontal plane 70. Right flange 57 extends into channel 44 of right wall 28 and left flange 57*a* extends into channel 46 of left wall 29. The top right surface of V-shaped section 56 of plate 54 sits flush against bottom 27 of support surface 8 to assist in supporting base 4 above work surface 7. Adjustment tab 37 of wall 29 abuts the stepped shoulder of flange 57*a* and the outer end of flange 57 abuts bottom surface 27 of base 8.

The equal and opposite angularly extending positions of FIGS. 5 and 7 and of FIGS. 6 and 8 allow the angular orientation of the shelf mounted on one side of the monitor to match the angular orientation of the shelf mounted on the other side of the monitor. That is, one pair of identical support shelves 1 allows the shelf to extend toward the operator at identical angles.

Accordingly, the improved support shelf of the present invention supports a speaker or other office related items on a monitor above horizontal work surface 7. Mounting plate 52 extends over the top of monitor 2 and attaches thereto as described above. Panel 50 extends vertically downwardly along the side of monitor 2 and adjustment plate 54 extends perpendicularly from a bottom of panel 50. Flanges 57 and 57*a* are selectively engageable into any one of the three channels 44–46 of bracket walls 28 and 29, respectively, to positively lock base 4 to upright 6 in one of five angularly adjusted positions (FIGS. 4–8) and prevent base 4 from rotating when bumped or when supporting excess weight. Wall 16 and particularly top lip 18 of support surface 8, prevents the speaker or other items from sliding or falling off of shelf 1.

It is understood that while the drawings show channels 44–46 and bracket 25 formed on base 4 and adjustment plate 54 formed on upright 6, it is obvious to one skilled in the art that adjustment plate 54 could extend from base 4 and bracket 25 could be mounted on upright 6. The base and upright would positively lock together in the same angular relationships as that shown in the drawings and described above.

It is also understood that while the drawings show bracket 25 having three channels 44–46 to facilitate the 7° and 17° angularly adjusted positions, bracket 25 could have any number of aligned channels to permit base 4 to positively lock to upright 6 in a plurality of angularly adjusted positions.

Accordingly, the improved support shelf is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved support shelf is constructed and used, the characteristics of the construction, and the advantageous, new and useful results obtained; the new and useful structures, devices, elements, arrangements, parts and combinations, are set forth in the appended claims.

We claim:

1. A support shelf for supporting a speaker or other items on a monitor, said shelf including:

an upright having a longitudinal axis adapted to extend adjacent to a side of the monitor;

a base mounted on and extending outwardly from the upright adapted to extend above a work surface; and attachment means for adjustably mounting the base on the upright, said attachment means includes a pair of spaced walls formed on the base and a plurality of spaced tabs extending inwardly toward each other from said walls forming a plurality of channels therebetween and flanges formed on the upright and selectively engageable in certain of the channels for positively securing said base in a fixed position on the upright with the base extending at an angular relationship with respect to the longitudinal axis of the upright.

2. A support shelf for supporting a speaker or other items on a monitor, said shelf including:

an upright having a longitudinal axis adapted to extend adjacent to a side of the monitor;

a base mounted on and extending outwardly from the upright adapted to extend above a work surface, said base having an elongated U-shaped opening formed therein and extending across a rear of said base for receiving a portion of the upright to allow said base to abut the side of the monitor; and attachment means for adjustably mounting the base on the upright, said attachment means includes a plurality of channels formed in one of the upright and base, and flanges formed on the other of said upright and base and selectively engageable in certain of the channels for positively securing said base in a fixed position on the upright with the base extending at an angular relationship with respect to the longitudinal axis of the upright.

3. The shelf defined in claim 2 in which the attachment means includes a pair of spaced walls formed on the base and a plurality of spaced tabs extending inwardly toward each other from said walls forming the channels therebetween.

4. The shelf defined in claim 3 in which the attachment means includes a pair of aligned flanges formed on an outwardly extending leg formed on the upright; and in which said flanges are slidably received in a selected pair of channels to mount the base on the upright at a selected angle.

5. A support shelf for supporting a speaker or other items on a monitor, said shelf including:

an upright having a longitudinal axis adapted to extend adjacent to a side of the monitor, said upright including a substantially Z-shaped bracket having a central panel and first and second legs extending at generally right angles to said central panel and parallel to each other, said first leg being adapted to be supported on a top surface of the monitor and said central panel being adapted to extend vertically along a side surface of the monitor;

a base adjustably mounted on the second leg of the upright and extending outwardly from said upright and adapted to extend above a work surface, said second leg including a mounting plate; and attachment means for adjustably mounting the base on the upright, said attachment means includes a plurality of channels formed on the base, and flanges formed on the mounting plate of the second leg and selectively engageable in certain of the channels for positively securing said base in a fixed position on the upright with the base extending at an angular relationship with respect to the longitudinal axis of the upright.

6. The shelf defined in claim 5 in which the mounting plate includes an inverted V-shaped section with an apex which is aligned with the longitudinal axis of the upright, and in which the flanges extend outwardly from said V-shaped section.

7. The shelf defined in claim 6 in which a plurality of spaced parallel fins extend downwardly from a bottom surface of said V-shaped section.

8. The shelf defined in claim 6 in which the V-shaped section includes a pair of surfaces which extend downwardly at an angle of approximately 17° with respect to a horizontal plane passing through the apex.

9. A support shelf for supporting an item on a monitor, said shelf including:

an upright having a longitudinal axis adapted to extend adjacent to a side of the monitor;

a base mounted on and extending outwardly from the upright and adapted to extend above a work surface; and attachment means for adjustably mounting the base on the upright, said attachment means includes a pair of spaced walls formed on one of the upright and base and a plurality of spaced tabs extending inwardly toward each other from said walls forming a plurality of spaced channels, and flanges formed on the other of said upright and base and selectively engageable in certain of the channels for positively securing said base in a fixed position on the upright with the base extending at an angular relationship with respect to the longitudinal axis of the upright.

10. The shelf defined in claim 9 in which the base includes a flat support surface.

11. The shelf defined in claim 10 in which a peripheral wall extends around the support surface and forms a peripheral lip extending above said support surface.

12. The shelf defined in claim 9 in which an elongated U-shaped opening is formed in the base and extends across a rear of said base for receiving a portion of said upright to allow said base to abut the side of the monitor.

13. The shelf defined in claim 9 in which adhesive means is attached to a bottom surface of a first leg of the upright for securing said upright leg to a top surface of the monitor.

14. The shelf defined in claim 9 in which each of the base and upright is a one-piece member formed of a plastic material.

* * * * *